US005427265A

United States Patent [19]

Cautereels et al.

[11] Patent Number: 5,427,265

[45] Date of Patent: Jun. 27, 1995

[54] LUNCHBOX WITH SAFETY LOCK

[75] Inventors: Victor J. J. Cautereels, Borsbeek, Belgium; Ian Ferris, Wokingham, United Kingdom

[73] Assignee: Dart Industries Inc., Deerfield, Ill.

[21] Appl. No.: 140,385

[22] Filed: Oct. 22, 1993

[51] Int. Cl.[6] ..... B65D 45/00

[52] U.S. Cl. ..... 220/318; 220/326; 220/338; 220/339; 220/755; 220/756; 206/541; 206/549; 206/1.5

[58] Field of Search ..... 220/318, 326, 338, 339, 220/755, 756, 768; 206/541, 542, 549, 1.5

[56] References Cited

U.S. PATENT DOCUMENTS

| | | | |
|---|---|---|---|
| D. 255,084 | 5/1980 | Petrie . | |
| D. 268,040 | 2/1983 | Ng . | |
| D. 322,031 | 12/1991 | Fleming . | |
| 2,745,524 | 5/1956 | Plotkin . | |
| 2,768,720 | 10/1956 | Nelson . | |
| 3,025,947 | 3/1962 | Hammer | 220/326 X |
| 3,317,077 | 5/1967 | Braginetz et al. | 220/338 |
| 3,513,951 | 5/1970 | Leong et al. . | |
| 3,960,289 | 6/1976 | Panicci | 220/318 |
| 4,216,862 | 8/1980 | Daenen | 206/541 |
| 4,279,342 | 7/1981 | Van Pelt | 206/542 |
| 4,314,651 | 2/1982 | Gaiser et al. | 220/326 |
| 4,351,448 | 9/1982 | Ingersoll et al. | 220/318 |
| 4,667,484 | 5/1987 | Tarozzi et al. | 62/371 |
| 4,819,827 | 4/1989 | DiSesa | 220/318 |
| 4,917,261 | 4/1990 | Borst | 220/342 |
| 4,989,744 | 2/1991 | Tominaga | 220/326 X |
| 5,111,920 | 5/1992 | Castelli et al. . | |
| 5,174,452 | 12/1992 | Wang | 206/542 |

*Primary Examiner*—Allan N. Shoap
*Assistant Examiner*—Vanessa Caretto
*Attorney, Agent, or Firm*—John A. Doninger

[57] ABSTRACT

A lunchbox including a lid and base pivotally engaged by snap together hinge assemblies and including a pivotal latch assembly and a separate lock assembly. The lock assembly includes a pair of locking collars on the pivoting handle on the base which engage a pair of lugs on the lid with withdrawal of the lugs being prevented in the carrying position of the handle.

14 Claims, 5 Drawing Sheets

34
14
32
28
78
104
80
30
34
106
64
72
104
46
12
42
46
26
48
24
44
60
90
22
68
20
18
16
82
62
84
100
94
24

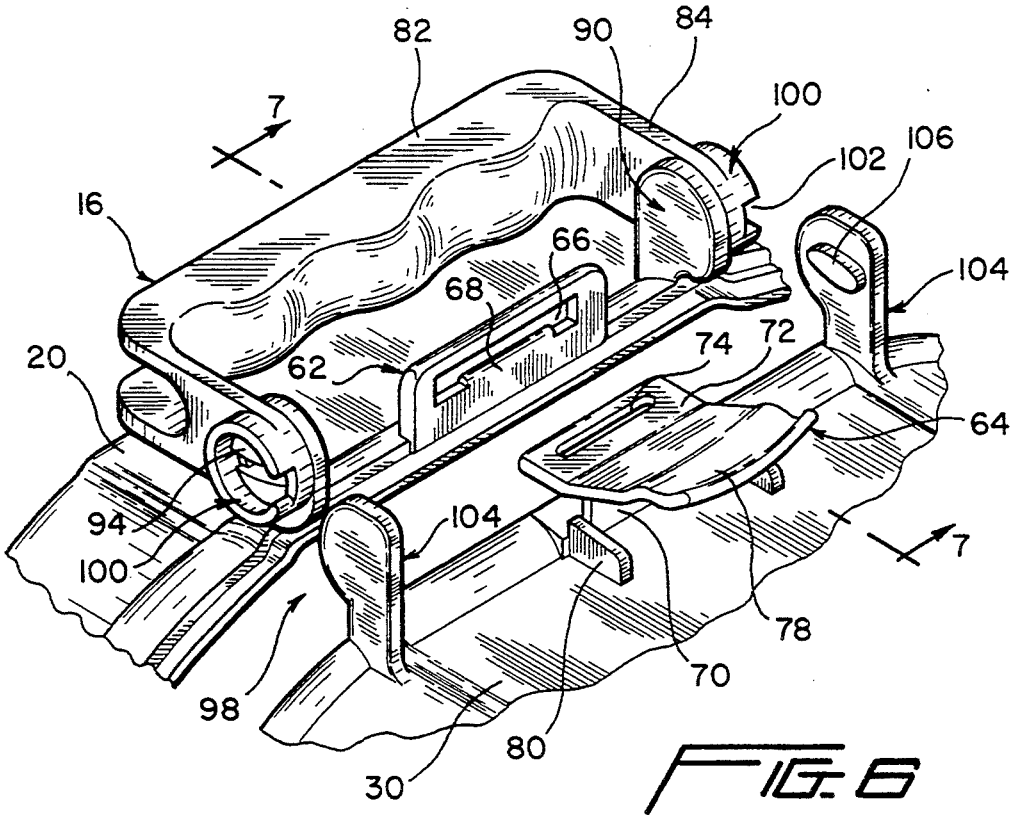
FIG. 6
FIG. 7
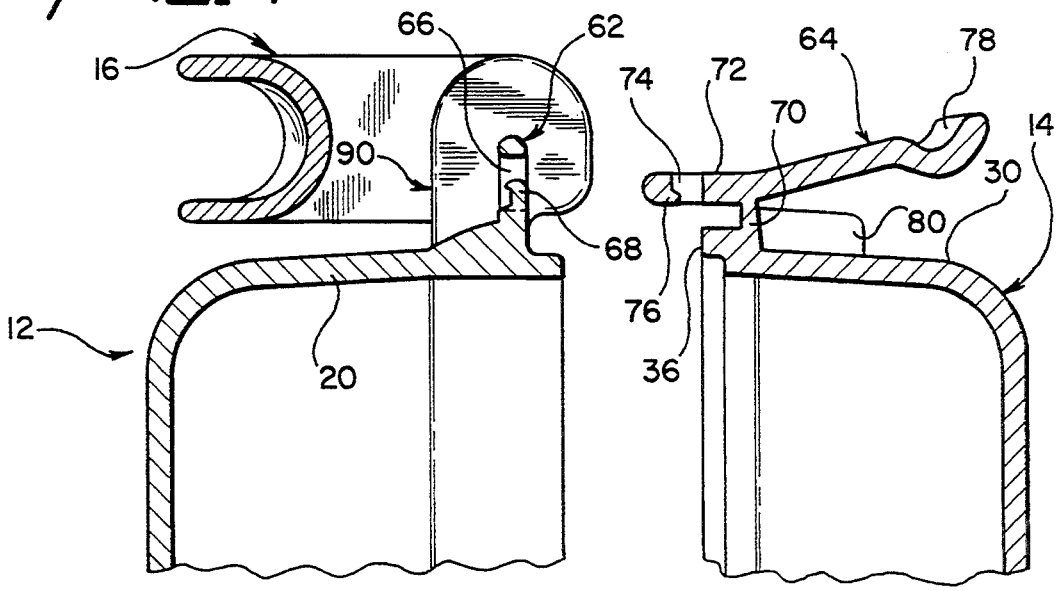

LUNCHBOX WITH SAFETY LOCK

BACKGROUND OF THE INVENTION

Carrying boxes, and especially lunchboxes, particularly when intended for use by small children, present special design problems.

The lunchbox must be relatively inexpensive, and at the same time of sturdy construction. The lunchbox should also be easily opened by a young child, while at the same time secure against accidental opening, particularly when subjected to relatively rough handling as might be expected as the children interact in travelling to and from school, on field trips, and the like.

While a degree of safety might be said to reside in a typical metal lunchbox incorporating duplicate spaced latches, such dual latches do not individually prevent the release of the other latch, but rather act independently of each other in securing spaced portions of the lunchbox. Each latch of such a dual latch arrangement must also be individually manipulated to both secure the lunchbox lid and release the lid. While the procedure involved is relatively simple and straightforward, when dealing with very young children, for example children of kindergarten age, such procedures can be a source of difficulty.

It will also be recognized that most conventional lunchboxes, particularly those of the type incorporating a handle, utilize a substantial number of individual pieces, including separate shells, hinges, latches, handles, and the like.

SUMMARY OF THE INVENTION

The handled carrying box of the present invention finds particular utility as a lunchbox for small children. In accord therewith, the lunchbox is constructed of only three separate units, each formed of an appropriate synthetic resin including an inherent degree of flexible resiliency and a capability of forming integral living hinges, e.g., polypropylene.

The box basically consists of separate molded base and lid shells, each including integral hinge components which snap lock together to secure the shells by a dual hinge assembly. A third component, a separately molded handle, snap locks to mounting brackets integral with the front wall of the base, thus completing the structure of the lunchbox.

A significant aspect of the invention is the provision of a lunchbox with a primary latch assembly which secures the lid to the base in a closed position and is so constructed as to automatically latch upon a closing of the lid, and to be easily manipulated, even by a young child, to allow an opening of the lunchbox.

In view of the desired basic simplicity of the latch assembly, which comprises a keeper and latch respectively integrally molded with the base and lid, a separate locking assembly is also provided. The locking assembly prevents accidental opening of the lunchbox and comprises cooperating components respectively on the handle and the opposed or lid shell. The lock components, including dual split locking collars on the handle and cooperating lugs or projections on the lid, are so positioned as to engage and disengage in only a single stored or rest position of the handle against the front wall of the base. This position is basically the position a handle normally assumes when a lunchbox is to be opened. The handle, in the conventional carrying position, or for that matter in any other position pivotally adjusted from the stored or rest position, so relates the locking collars to the locking lugs as to preclude disengagement and release of the lid from the base even should the latch assembly be inadvertently manipulated. Thus, accidental opening of the lunchbox, particularly when being carried in a conventional manner, is not possible.

When the lunchbox is to be opened, the lock assembly presents no encumbrance to the opening of the box in that the lock assembly is automatically released upon movement of the handle to its stored position, the position normally assumed when the box is to be opened as a convenient means for holding or stabilizing the base by one hand of the user as the latch assembly is released and the lid pivoted away from the base by the second hand.

These features of the invention, together with the advantages derived therefrom, will become apparent as the details of construction and manner of use of the invention are more fully hereinafter presented.

BRIEF DESCRIPTION OF THE DRAWINGS

FIG. 6 is a partial perspective view of the front walls of the two shells with the latch assembly and lock assemblies disengaged;

FIG. 7 is an enlarged cross-sectional detail taken substantially on a plane passing along line 7—7 in FIG. 6;

DESCRIPTION OF PREFERRED EMBODIMENT

Figure 1:
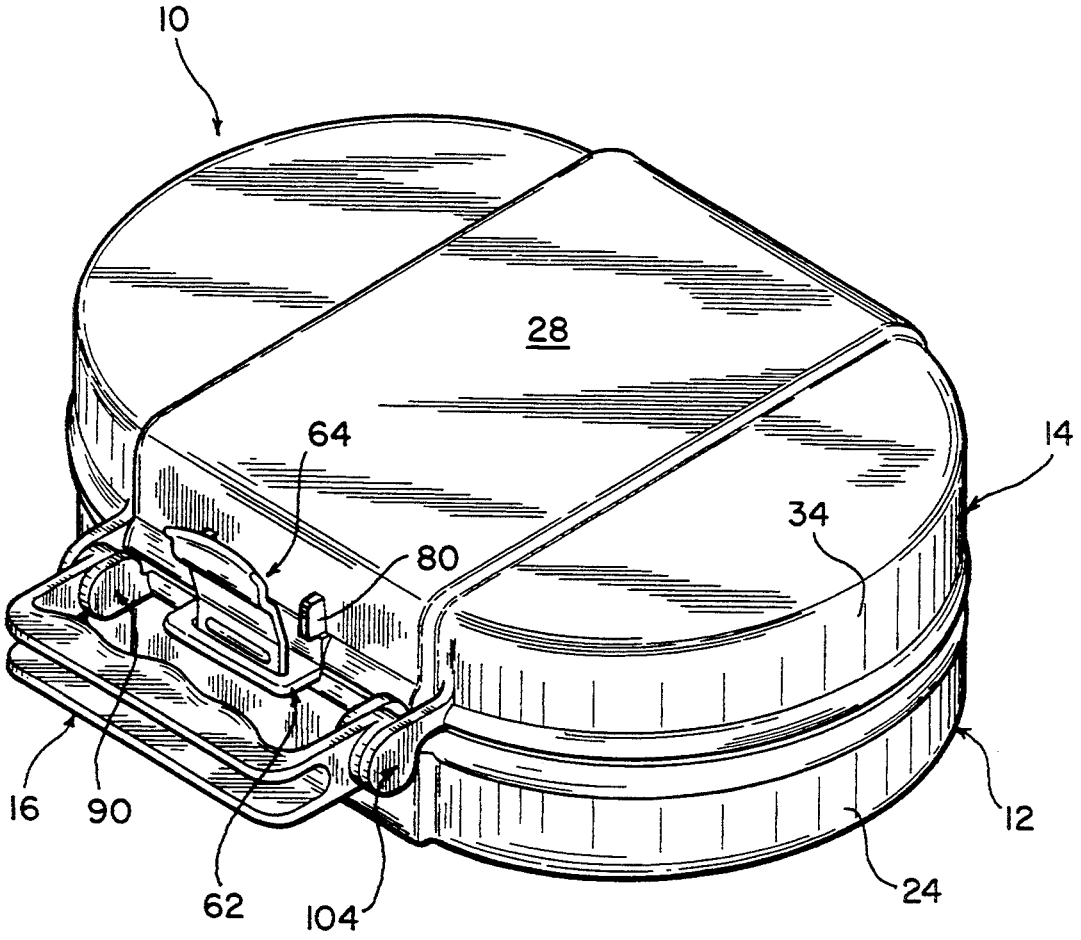
FIG. 1 is a perspective view of the closed lunchbox.
Figure 2:
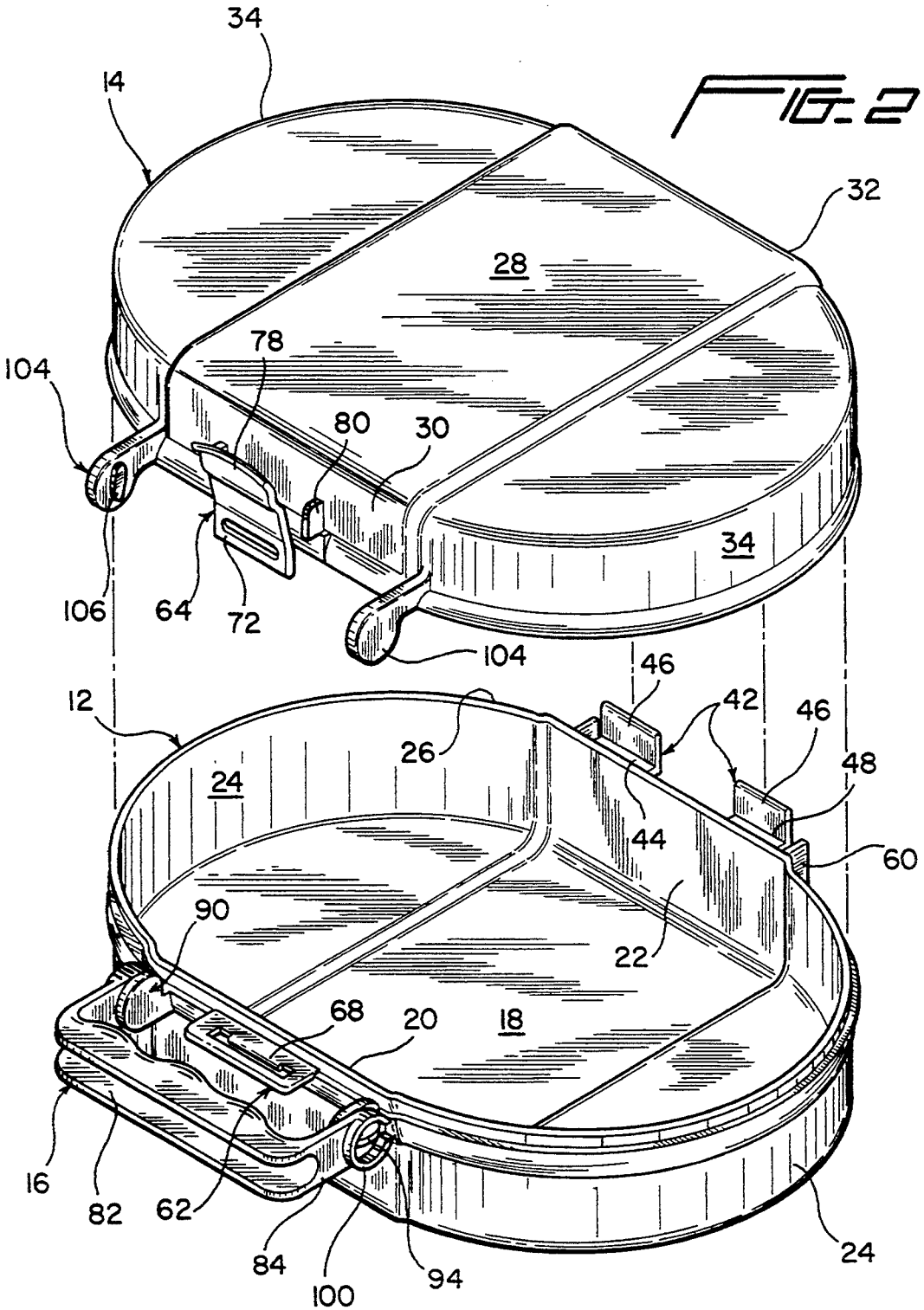
FIG. 2 is an exploded perspective view of the two shells of the lunchbox.

Referring now more specifically to the drawings, the carrying box or handled lunchbox 10 consists of a base shell or base 12, a lid shell or lid 14, and a handle 16, each molded of an appropriate synthetic resinous material, and each including cooperative components for a joinder of the three units to define an assembled lunchbox. While not limited thereto, the preferred configuration of the lunchbox, as illustrated, includes opposed linear sides and arcuate or semicircular ends.

The base 12 comprises a bottom 18, opposed generally planar front and rear walls 20 and 22, and opposed arcuate end walls 24. The walls 20, 22 and 24 define a continuous peripheral wall assembly about the bottom 18 and are integrally molded therewith. The peripheral wall assembly, remote from the bottom 18, terminates in a continuous upper rim 26.

The lid 14, similarly configured to mate with the base 12, includes a top 28 opposed generally planar front and rear walls 30 and 32, and opposed arcuate end walls 34. The walls 30, 32 and 34 are integral with the top 28 and define a peripheral wall assembly continuously about the periphery thereof, terminating in a continuous outer edge or rim 36 which, in the closed position of the lunchbox, seats and seals against the base rim 26. This is illustrated in the sectional detail of FIG. 4 which also illustrates an integral positioning flange 38 immediately outward of and extending beyond the lid rim 36 to engage with the outer surface of the peripheral wall assembly of the base.

Figure 3:
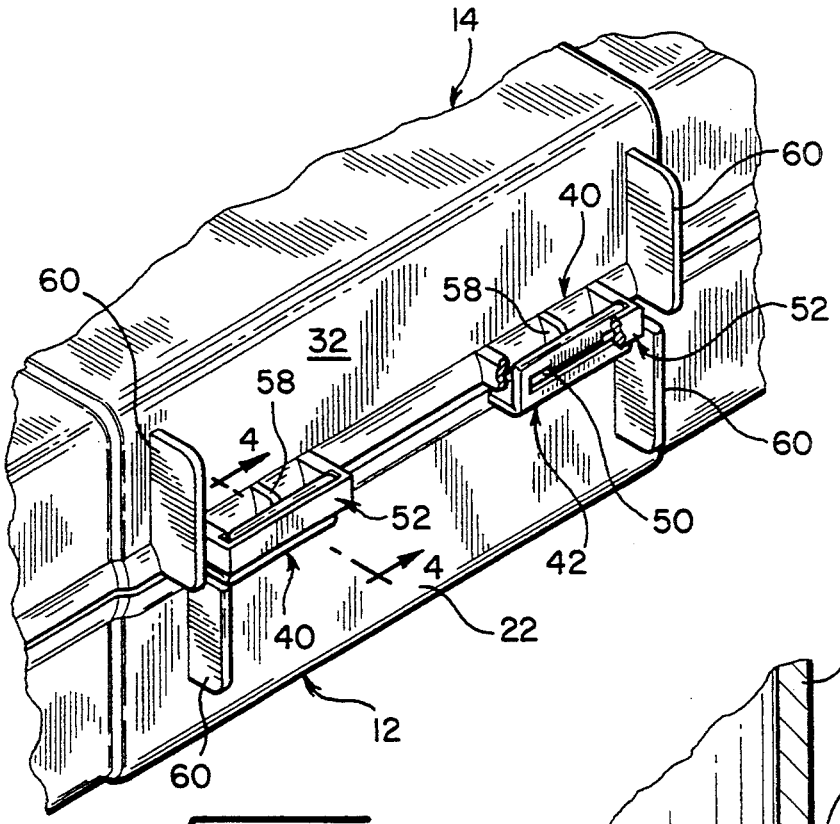
FIG. 3 is a perspective detail of the rear walls of the shells and the hinge assemblies pivotally joining the rear walls, with one assembly partially broken away for purposes of illustration.
Figure 4:
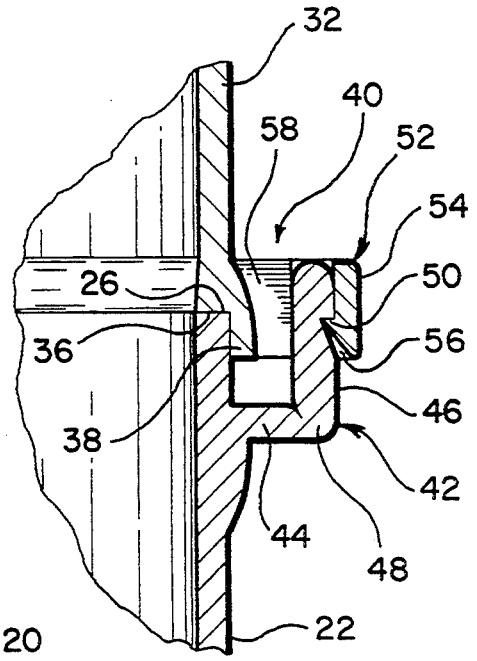
FIG. 4 is an enlarged cross-sectional detail through a hinge assembly and taken on a plane passing along line 4—4 in FIG. 3.
Figure 5:
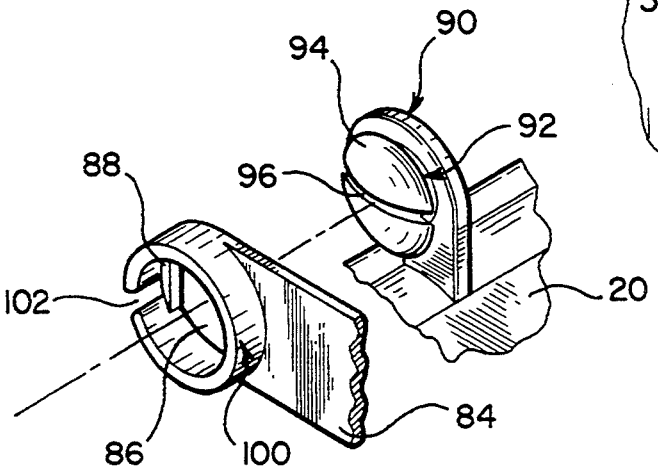
FIG. 5 is an exploded perspective detail illustration one of the two handle-mounting assemblies.

Noting FIGS. 3 and 4, the base and lid shells are pivotally interconnected, for a selective closing and opening of the lid 14 relative to the base 12, by duplicate hinge assemblies 40 longitudinally spaced from each other along the rear walls 22 and 32. Each hinge assembly 40 includes a hinge panel 42 extending from the base rear wall 22 and comprising an inner portion 44 integral with the wall 22, and an outer portion 46 jointed to the inner portion by an integral living hinge 48. The rearwardly directed face of the outer panel portion 46 includes a recess therein defining a downwardly directed shoulder 50.

A mating keeper or retainer 52 is provided for each of the hinge panels, and is integrally formed with the rear wall 32 of the lid and so positioned as to receive the corresponding hinge panel outer portion 46. Each keeper 52 comprises a U-shaped member with the legs thereof integral with the rear wall 32 and the crossbar 54 in outwardly spaced relation to the wall 32. The crossbar 54 is of a length slightly greater than that of the hinge panel outer portion 46 for a sliding introduction of the outer portion 46 into the keeper 52 immediately inward of the crossbar 54. The crossbar 54 is provided with an inwardly projecting integral lug 56 which cooperates with the shoulder 50 on the hinge panel outer portion for a snap-joining of the hinge panel 42 to the keeper 52. In order to stabilize this engagement, a transverse backing plate 58 is provided within each keeper 52, integrally formed with the rear wall 32 and projecting outward to restrict the depth of the keeper sufficient so as to prevent accidental disengagement of the hinge panel from the keeper once the hinge panel is engaged. As suggested in FIG. 4, an appropriate bevel can be provided on the inner face of the keeper lug 56 to facilitate engagement in conjunction with the inherent resilient flexibility of the material of the hinge assembly. Once assembled in the above manner, the lid becomes unitary with the outer portion 46 of the hinge panel 42 and is thereby mounted for pivotal movement relative to the base about the corresponding living hinge 48, one such living hinge being provided by each of the hinge assemblies 40.

With further reference to FIG. 3, it will be noted that each of the base and lid rear walls 22 and 32 is provided with a pair of rearwardly projecting plate-like feet 60 which projects slightly beyond the two hinge assemblies 40 just laterally outward thereof. These feet 60 enable a standing of the lunchbox 10 upright. The legs also function as a convenient means to limit the outward swinging of the lid 14 relative to the base 12, to a position wherein the lid and base are aligned or in a generally common plane to provide convenient dual serving compartments.

The lunchbox 10, when closed, is latched by a releasable latch assembly comprising a keeper 62 mounted on the front wall 20 of the base slightly inward of the rim or upper wall edge 26, and a pivoting latch 64 integrally molded with the front wall 30 of the lid 14.

The keeper 62 includes an elongate slot 66 therethrough parallelling the front wall 20. The back edge of the slot, that is the edge closest to the wall 20, has a forwardly projecting undercut lip 68 centrally therealong.

The latch 64 is generally in the nature of a panel of a width slightly less than the length of the slot 66. A hinge bar or plate 70 extends transversely across the latch 64 intermediate the opposed edges thereof, and integrally joins the latch 64 to the lid front wall 30. The latch 64, forward of the hinge bar 70, that is toward the rim edge 36 of the lid 14, defines a catch portion 72 which is selectively received through the keeper slot 66. The catch in turn has a transverse slot 74 therein which includes a lip 76 along the outer edge of the slot 74, that is the edge of the slot closest to the free edge of the catch portion. This lip 76, upon an engagement of the catch portion 72 through the keeper slot 66, snap locks behind and in engagement with the keeper lip 68.

That portion of the latch 66 to the opposite side of the hinge bar 70 from the catch 72, designated by reference numeral 78, defines a pressure pad or area for selected manual release of the catch 72 from the keeper 62 upon a pivoting of the latch 64 through the inherent flexing of the hinge bar 70. As will be appreciated from the drawings, the pressure pad portion 78 is of a substantially greater length than the catch portion 72 and is configured to provide a finger gripping surface, both features of which facilitate manipulation of the latch 64, particularly by a young child.

It is to be recognized that the latch 64, in its at rest or unflexed position, is so oriented as to provide for a snap lock of the catch portion 72 with the keeper as the lid is brought to a closed position. In releasing the latch, inward pressure on the pad portion 78, again through a slight snapping action, disengages the catch lip 76 from the keeper lip 68 and allows for a withdrawal of the latch from the keeper slot 66 in an obvious manner. As desired, one or more abutments 80 can be integrally formed with the lid front wall 30 in underlying relation to the pressure pad portion 74 of the latch 68 to limit the inward flexing of the latch 64 to both properly align the catch portion 72 for withdrawal from the keeper slot 66 and to avoid any necessary excess flexing of the latch hinge bar or panel 70. Incidentally, it will be appreciated that the size and configuration of the pressure panel 78 is such as to actually provide a handle which, in addition to facilitating release of the latch, also allows the user to grasp and outwardly swing the lid 14 relative to the base 12.

The handle 16 is of a basic U-shaped configuration with a central hand grip bar or portion 82 and opposed legs 84, each having a transverse mounting opening 86 defined therethrough. Each opening is basically circular, interrupted only by a pair of opposed segment-shaped shoulders 88.

A pair of cooperating mounting brackets 90 are integrally formed with and project forwardly from the front wall 20 of the base 12. Each of the brackets 90 includes an integral laterally extending cylindrical stub shaft 92 terminating in an outer slightly domed enlarged head 94 of a diameter only slightly less than that of the corresponding opening 86, each head having a central slot or kerf 96 defined thereacross.

The inherent resiliency of the peripheries of these enlarged heads 94, as well as the slight domed configuration thereof, enable a snap locking through the corresponding handle openings 86, past the segment shoulders 88. Preferably, to aid in engagement of the handle on the two stub shafts 92, the handle 16 will be rotated to position the opposed segments 88 perpendicular to the head kerfs 96, thereby aligning the relatively weaker peripheral portions of each head 94 with the shoulders 88 to facilitate a flexing and snapping past the shoulder portions. Once the handle 16 is mounted on the stub shafts 92 of the two brackets 90, the handle is free to rotate between opposed positions respectively overlying the base and lid front walls, and to any intermediate position therebetween, for example perpendicular to the front walls in a normal carrying position.

Figure 12:
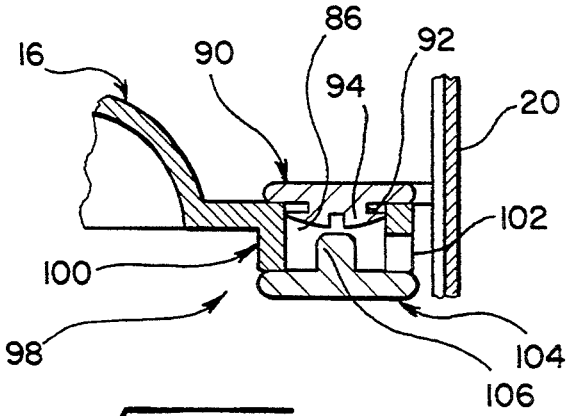
FIG. 12 is a cross-sectional detail through one of the lock assemblies and the corresponding handle mount assembly taken on the plane of line 12—12 in FIG. 10.

The handle 16, in addition to its conventional use as a means for conveniently carrying the lunchbox, has another and particularly significant function. More particularly, the handle 16 controls a lock assembly 98, preferably a pair of duplicate assemblies 98, one associated with each handle leg 84. Each lock assembly 98 includes, as a first component thereof, a keeper in the form of a cylindrical lock collar 100 integral with and projecting laterally outward from the corresponding handle leg in surrounding relation to and coaxial with the opening 86 therein. The lock collar 100 is a split collar, that is provided with an access notch 102 radially therethrough and both opening toward and centrally aligned with the extreme outer end of the handle or handle leg. Noting FIG. 12 in particular, it will be appreciated that the lock collar 100 extends substantially beyond the enlarged head 94 on the stub shaft 92 of the corresponding mounting bracket 90 when engaged through the corresponding handle opening 86 for pivotally mounting the handle.

The second lock component of each lock assembly 98 comprises a lock post or bracket 104 integral with and projecting forwardly from the lid front wall 30 to align immediately outward of an associated handle collar 100 upon a closing of the lid over the base. Each of these lock brackets 104 includes an integral locking lug 106 on the lateral inner face thereof. The lug 106 projects laterally inward from the bracket 104 and is elongate in a direction generally parallel to the front wall 30 of the lid 14 and perpendicular to the rim edge thereof. The lug 106 is of a length slightly less than the internal diameter of the associated collar 100.

Each lock bracket 104 is so positioned whereby, upon a closing of the lid 14 over the base 12 the lock bracket 104 will lie immediately adjacent the outer edge of the associated collar 100. The lock lug 106, in turn, will be positioned within the collar.

Figure 8:
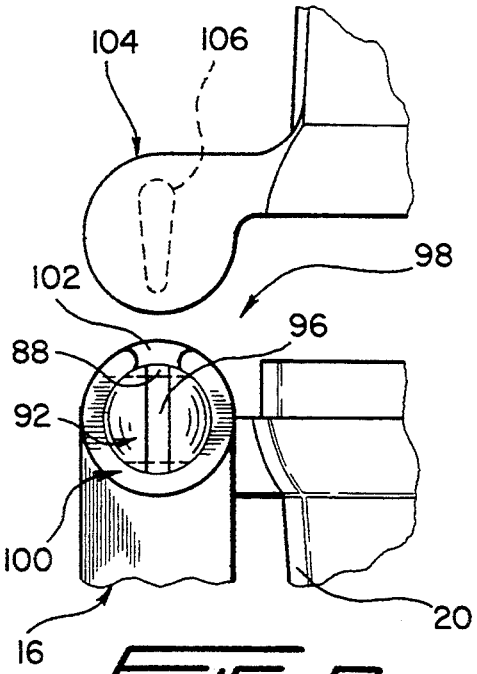
FIG. 8 schematically illustrates a pair of lock components, respectively on the front walls of the two shells, aligned for engagement.
Figure 9:
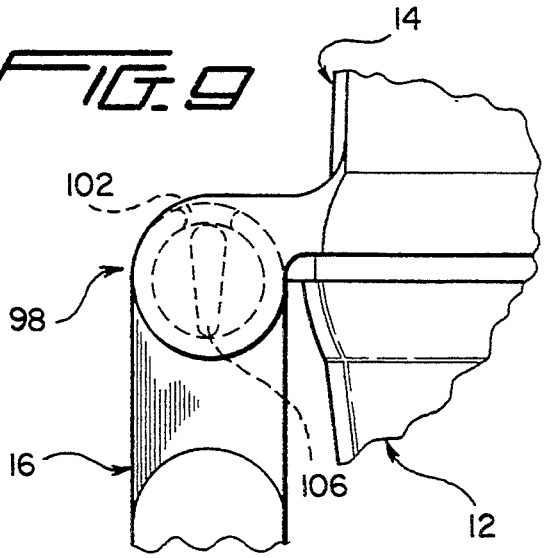
FIG. 9 is a schematic illustration similar to FIG. 8 with the lock components engaged.

Noting FIGS. 6, 8 and 9 in particular, in order to engage the lock lug or Lugs 106 within the corresponding collar or collars 100, and thus engage each lock assembly 98, the handle must be aligned to overlie and substantially parallel the base front wall 20. This in turn aligns the collar notches 102 with the corresponding lock lugs 106 for a movement of the lugs 106 into the associated collars 100 as the lid is closed. As will be appreciated, this movement effects a corresponding engagement of the latch assembly, or more particularly the latch 64 within the keeper 62. It will be noted that the lugs 106 are slightly tapered toward a narrower leading end relative to the access notches 102 whereby alignment and proper engagement of the lugs 106 within the associated collars is facilitated.

Figure 10:
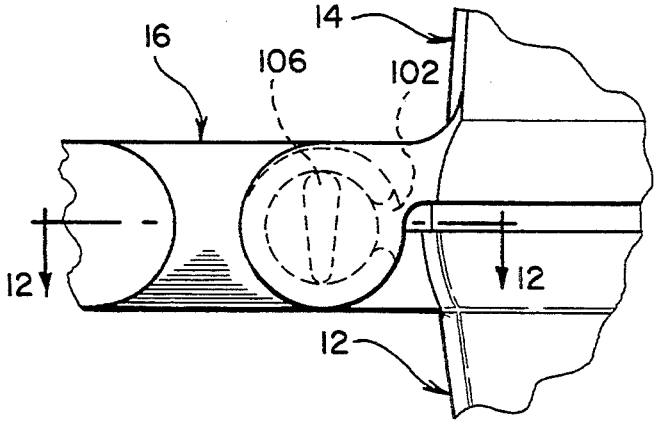
FIG. 10 is a similar schematic illustration with the handle pivoted to a carrying position and the lock components fixed against release.
Figure 11:
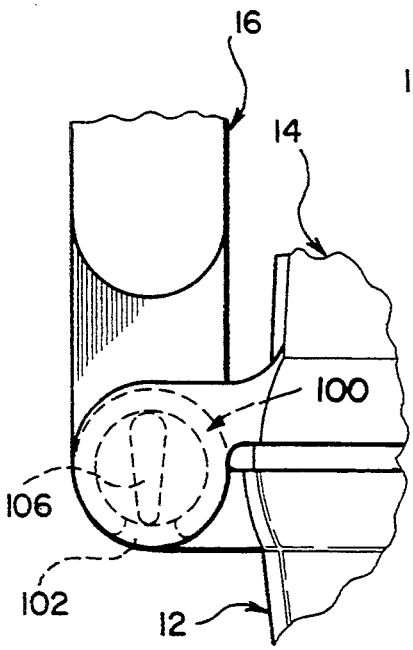
FIG. 11 is a similar schematic illustration with the handle in a second lifting position and the lock components fixed against release.

Noting FIGS. 8 and 9, when closing the lunchbox, the base will normally be horizontally oriented on a table or the like, and the lid pivotally closed downward thereagainst. The handle 16 will normally be in a stored or release position depending from the mounting brackets immediately forward of and generally parallel to the base front wall 20, thus aligning the collar access notches for reception of the lock lugs 106. After the lid has been closed, the handle, noting FIGS. 10 and 11, will, in the normal manner, be rotated into a carrying or lifting position. Upon the pivotal rotation of the handle, the access ports 102 of the collars 100 are rotated away from the initial assembling position. In other words, once the handle 16 is rotated away from its release position adjacent the base front wall, withdrawal of the lock lugs 106 through the access openings 102 is precluded, whether or not the central latch assembly 62, 64 is itself released. Thus, any possibility of the lunchbox accidentally opening while being carried by the handle, in the normal manner of such lunchboxes, is effectively prevented.

When the lunchbox is to be opened, the box may be positioned upright, resting on the supports or feet 60, with the handle 16 in a normal manner swung to its release position overlying the base front wall 20 as in FIG. 6. The latch 64 can then easily be engaged by one hand, slightly depressed and released to outwardly swing the lid. As a counter force to the outward swinging of the lid, the second hand of the user can lightly grasp the handle 16. This will also ensure that the handle does not swing away from the release position until such time as the lid is released. Minimal manual dexterity is required, notwithstanding the dual latch and lock assemblies and the safety features provided thereby.

Contrary to conventional latch assemblies, which in many instances can be a rather cumbersome and difficult to manipulate, particularly for the very young, the assemblies of the invention, while structurally unique, are of rather simple and trouble free construction, capable of being engaged and disengaged with equal facility. Incidentally, it will be recognized that should the handle 16 be so pivoted as to engage against the pressure pad 74 of the latch, either accidentally or intentionally to fold the handle to a stored position, such an engagement will not release the lid in that the lock assembly or assemblies will, in this position, be fully engaged.

From the foregoing, it will be appreciated that the invention discloses a unique safety lock assembly which automatically engages and remains engaged in any normal carrying position of the lunchbox, thereby preventing any possibility of an accidental opening of the lunchbox, particularly as the box is being carried. In addition, the unique secondary lock assembly, which in itself is easily disengaged, eliminates the necessity for the use of a complex latch assembly or multiple latches as could be too challenging for a young child. Thus, the invention combines security and simplicity, both of particular significance in a child's lunchbox.

We claim:

1. A carrying box including first and second shells, each shell comprising a peripheral wall including a front wall portion and a rear wall portion, hinge means joining said rear wall portions for selective pivotal movement of said shells between a closed position overlying each other and closing said box, and an open position with said shells outwardly pivoted relative to each other, latch means comprising first and second selectively interlockable latch components, one on each of said shell walls remote from said rear wall portions, said latch components aligning and engaging in said closed position for retention of said shells against movement to said open position, a carrying handle, at least one mount on said first shell wall remote from said rear wall portion thereof, means engaging said handle to said mount for movement of said handle between a carrying position extending generally perpendicular to said first shell wall, and a release position remote from said carrying position, and lock means for locking said shells in said closed position independently of said latch means, said lock means comprising a first lock component on said handle and a second lock component on said second shell wall, said lock components being alignable and releasably engageable upon movement of said shells to said closed position and with said handle in said release position remote from said carrying position, said lock components locking against release upon movement of said handle from said release position toward said carrying position.

2. The carrying box of claim 1 wherein said means engaging said handle to said mount comprises pivot means for pivotal movement of said handle between said carrying position and said release position.

3. The carrying box of claim 2 wherein said first lock component comprises a keeper with an access opening therein, said second lock component comprising a lug receivable in said keeper through said access opening, said access opening aligning with said lug solely in said release position of said handle whereby withdrawal of said lug from said keeper is precluded in other than said release position.

4. The carrying box of claim 3 wherein said pivot means comprises a pivot pin on said mount, and an aperture defined in said handle and receiving said pin, said keeper comprising a collar on said handle encircling and coaxial with said aperture whereby said collar rotates, upon pivotal movement of said handle, about said pivot pin, said access opening being defined radially through said collar at an area on the periphery of said collar for radial introduction of said lug into said collar.

5. The carrying box of claim 4 wherein said latch means and said lock means are both mounted on said front wall portions.

6. The carrying box of claim 5 wherein said handle is substantially U-shaped and comprises a grip bar with laterally extending legs at opposite ends thereof, said pivot means being associated with one of said handle legs, with said pivot means aperture being defined in said one of said handle legs.

7. The carrying box of claim 6 including duplicate pivot means associated with the second one of said legs.

8. The carrying box of claim 7 wherein said lock means includes one of said first lock components on each handle leg, and one of said second lock components on said second shell wall aligned with each of said first lock components.

9. The carrying box of claim 8 wherein said latch components are aligned between said handle legs.

10. The carrying box of claim 9 wherein said first latch component comprises a latch, a pivot member integrally mounting said latch on said second shell wall, said latch including a catch and a pressure area for selective manipulation of said latch to release said latch catch, said second latch component including a latch keeper on said first shell automatically engaging and retaining said latch catch in said closed position of said shell for selective release by manipulation of said pressure area.

11. The carrying box of claim 10 wherein said hinge means comprises a retainer and a hinge panel on respective ones of said rear wall portions, said hinge panel having a living hinge defined thereacross, said hinge panel including an insert end to one side of said living hinge and releasably locked within said retainer and fixing said shells together for pivotal movement of said shells between open and close positions about said living hinge.

12. The carrying box of claim 11 wherein said pivot pin includes an enlarged head on the outer end thereof remote from the associated mount, said enlarged head including resiliently flexible peripheral edge portions, the associated pin receiving aperture including shoulder means for engagement inward of said head of said associated pivot pin upon forcible engagement of said head through said aperture.

13. The carrying box of claim 4 wherein said pivot pin includes an enlarged head on the outer end thereof remote from the associated mount, said enlarged head including resiliently flexible peripheral edge portions, the associated pin receiving aperture including shoulder means for engagement inward of said head of said associated pivot pin upon forcible engagement of said head through said aperture.

14. The carrying box of claim 1 wherein said hinge means comprises a retainer and a hinge panel on respective ones of said rear wall portions, said hinge panel having a living hinge defined thereacross, said hinge panel including an insert end to one side of said living hinge and releasably locked within said retainer and fixing said shells together for pivotal movement of said shells between open and close positions about said living hinge.

* * * * *